US009595241B2

(12) United States Patent
Zhu et al.

(10) Patent No.: US 9,595,241 B2
(45) Date of Patent: Mar. 14, 2017

(54) ADDRESSABLE DRAWER ORGANIZER WITH ITEM DISPLAY PANEL

(71) Applicants: Shengbo Zhu, San Jose, CA (US); Su Shiong Huang, Bellevue, WA (US)

(72) Inventors: Shengbo Zhu, San Jose, CA (US); Su Shiong Huang, Bellevue, WA (US)

(73) Assignee: iMICRODATA CORPORATION, San Jose, CA (US)

( * ) Notice: Subject to any disclaimer, the term of this patent is extended or adjusted under 35 U.S.C. 154(b) by 30 days.

(21) Appl. No.: 14/544,430

(22) Filed: Jan. 6, 2015

(65) Prior Publication Data

US 2016/0196798 A1 Jul. 7, 2016

(51) Int. Cl.

| | |
|---|---|
| ***G09G 5/12*** | (2006.01) |
| ***A47B 67/00*** | (2006.01) |
| ***G07F 17/00*** | (2006.01) |
| ***A47B 67/02*** | (2006.01) |
| ***A47B 67/04*** | (2006.01) |
| *A47B 95/02* | (2006.01) |

(52) U.S. Cl.

CPC ..... *G09G 5/12* (2013.01); *A47B 67/00* (2013.01); *A47B 67/02* (2013.01); *A47B 67/04* (2013.01); *G07F 17/0092* (2013.01); *A47B 2095/025* (2013.01); *G09G 2340/14* (2013.01); *G09G 2370/06* (2013.01); *G09G 2370/16* (2013.01)

(58) Field of Classification Search

CPC ..... A47B 88/04

USPC ..... 345/1.1–1.3

See application file for complete search history.

(56) References Cited

U.S. PATENT DOCUMENTS

| | | | | |
|---|---|---|---|---|
| 5,721,531 | A * | 2/1998 | Garver | B42F 15/0094 235/385 |
| 2014/0046482 | A1* | 2/2014 | Michael | A61J 7/0084 700/236 |
| 2014/0308828 | A1* | 10/2014 | Ehlen | H01R 25/14 439/110 |

* cited by examiner

*Primary Examiner* — Amare Mengistu
*Assistant Examiner* — Sarvesh J Nadkarni

(57) ABSTRACT

A drawer organizer for facilitating the location of an item stored in one of several drawers in one or more drawer organizer cabinets. Each drawer has an LED and a display device mounted on a front panel, as well as a CPU and a display device driver. The CPU memory contains the address of the associated drawer and communicates with an associated controller which receives drawer address and display information from a host computer. A user specifies an item to be retrieved from one of the cabinet drawers, the host computer transmits drawer identification signals to the controller, which converts these signals to a drawer address and supplies the drawer address to all drawer CPUs in the cabinet. If the incoming address matches the address stored in CPU memory of one of the drawers, this result is conveyed via the controller to the host computer, which then sends item display information to the controller. The controller forwards this information to the CPU, which relays this information to the display device driver and the information is displayed to the user. The CPU also activates the drawer LED.

8 Claims, 5 Drawing Sheets

ADDRESSABLE DRAWER ORGANIZER WITH ITEM DISPLAY PANEL

BACKGROUND OF THE INVENTION

This invention relates to drawer organizer systems in general, and in particular to an improved addressable drawer organizer with an item display panel and other useful features.

Drawer organizer systems are known and are used generally to store small items in drawers which are slidably mounted in a cabinet designed for this purpose. The cabinet is usually fixed to a wall or a support surface, such as a work bench. Each drawer typically has a drawer pull mounted on a front panel so that a user can slide the drawer outwardly from the cabinet and gain access to the contents of the drawer. Cabinets and drawers have been fabricated from both metal and plastic, with some drawer organizers using metal for both the cabinet and the drawers, others using plastic for both the cabinet and the drawers, and others using a metal cabinet and plastic drawers. The plastic materials used in the past have been either opaque or translucent.

Many types of items can be stored in a drawer organizer. Some examples are fasteners of several kinds, such as nuts, bolts, washers, sheet metal screws, and wood screws; grommets of various sizes; O-rings; electrical connectors; small electronic components, such as diodes, resistors, and capacitors; and medications of various kinds, such as prescription pharmaceuticals, over-the-counter medical remedies and the like. Drawer organizers are found in homes, business premises, work shops and manufacturing facilities, and have proven to be useful in a wide variety of situations requiring the organized storage of small items for future access.

A principal difficulty encountered with the use of drawer organizers lies in the manner of retrieving desired items from the collection of items stored in the several drawers in a given cabinet. In particular, retrieving the correct item requires identifying the contents of individual drawers until the correct drawer is found. In some applications, visual inspection through a transparent front drawer panel is the technique relied upon to identify the types of articles contained in that drawer. In other applications, small labels are adhered to the front panel of the drawers, with each label containing a brief description of the articles contained in that drawer. Both techniques are less than optimal. The visual inspection technique divulges only a minimum of subjective information about the contained articles. Similarly, the label technique is limited by the amount of space available on the label to describe the contained articles. Depending on the nature of the contained articles, the label technique cannot adequately distinguish the articles in one drawer from the articles in other drawers. For example, if the contained articles are resistors of different resistance values and power ratings, it is at best difficult to adequately distinguish among the several choices. The label technique also suffers from the disadvantage that the labels must be changed whenever the kinds of articles contained in a given drawer are changed. Both techniques are relatively inefficient in enabling quick identification of the correct drawer in applications having large collections of different types of articles. In general, the larger the number of drawers, the slower the access time to the contents of the desired drawer.

U.S. Pat. No. 6,348,864 issued Feb. 19, 2002 for "Organizer Management System Using R.F. identification", the disclosure of which is hereby incorporated by reference, discloses an organizer management system which is devoid of the above-noted limitations and disadvantages, which can be implemented using any articles suitable for containment in an organizer drawer, and which greatly facilitates ready access to specific items contained in organizer drawers. More particularly, the '864 patent discloses a drawer organizer management system using r.f. identification of individual drawers in a cabinet. The system includes a cabinet having a structure including a rear wall for providing a plurality of drawer locations, the cabinet having a plurality of pairs of external terminals adapted to be coupled to an r.f. signal generator for receiving r.f. signals from the generator, with each of the external terminal pairs being arranged preferably on the rear wall in a position corresponding to a different one of the drawer locations.

A plurality of drawers are each slidably mounted in a different one of the drawer locations between a closed position and an opened position. Each of the plurality of file drawers has a pair of electrically conductive drawer terminals adjacent the rear thereof and are adapted to engage a corresponding pair of the external terminals, a pair of electrical r.f. signal conductors coupled to the drawer terminals, and an r.f. circuit coupled to the pair of r.f. signal conductors. Each of the r.f. circuits has a crystal resonant at a specific frequency and a visible indicator activated whenever the associated crystal detects an r.f. signal at the specific frequency of that crystal. The resonant frequency of each of the crystals is different from the remaining ones of the crystals so that an r.f. signal of a specific frequency applied to the external input terminals of the cabinet causes only one of the plurality of crystals to resonate and only the visible indicator associated to that crystal to be activated.

Each of the drawers has a front panel, and each of the indicators is located on the front panel of the corresponding drawer so as to provide a visible indication of a resonant crystal in the drawer when the drawers are closed. Each of the visible indicators preferably comprises an LED. Each of the drawers also has a rear panel, and the pair of electrically conductive drawer terminals is preferably mounted on the rear panel. Each of the drawers is further provided with a positive detent mechanism for promoting contact between the electrically conductive drawer terminals and the external terminals. Each of the drawers is also provided with a pair of positive contact elements, such as a pair of springs, for promoting contact between the electrically conductive drawer terminals and the external terminals.

The system is used to locate the drawer containing a desired type of item in the following manner. A user enters the identity of a desired item in the system computer, either via a keyboard or by using a mouse to select an item from a list displayed on the computer monitor. In response, the computer performs a table-lookup from a set of frequencies which are uniquely associated to the items stored in the drawers. Once the corresponding frequency has been found, the computer instructs the r.f. signal generator to generate r.f. signals of the correct frequency. These r.f. signals are coupled to the individual cabinet drawers, and the r.f. circuit having the crystal of the correct frequency resonates, thereby illuminating the corresponding visible indicator on the drawer front panel. The user now knows which drawer contains the desired item.

The r.f.signal technology used in the '864 system essentially provides drawer identification signals (the r.f.signals of a specific frequency) and a drawer address comparison circuit for each drawer (the r.f.circuits each having a crystal of a unique specific frequency). This arrangement can be modified by replacing the r.f. technology with host computer generated digital drawer identification signals and address decoders located in each drawer circuit so that the host computer generates drawer identification signals which are broadcast to all drawer cabinets in the system using either wired or wireless communication links. In such an arrangement, the received drawer identification signals are inspected by the address decoders in each drawer circuit and the drawer circuit containing the address decoder having the unique address specified by the received drawer identification signal responds by activating the visible indicator on the front panel of that drawer.

The '864 system provides a low cost, effective and convenient technique for facilitating the location of specific items contained in a drawer organizer system. In addition, the '864 system eliminates, or substantially reduces the need for reliance on the labelling practice followed in setting up drawer organizer systems. Moreover, the '864 system affords great flexibility in arranging drawer organizers. In particular, the identity of the items in any given drawer can be easily changed by modifying the description in the system computer. Also, additional drawers can be added to expand the inventory held in the system, and existing drawers can be deleted from the system by changing the information stored in the computer.

While possessing all the advantages noted above over previous drawer organizer systems, the '864 system requires the use of the pair of electrically conductive drawer terminals adjacent the rear thereof to engage the corresponding pair of external r.f .signal terminals, the inclusion of the pair of electrical r.f. signal conductors coupled to the drawer terminals and the drawer r.f. circuit, and the provision of the positive detent spring mechanism for promoting contact between the electrically conductive drawer terminals and the external terminals. These elements require careful installation in order to construct a fully functioning unit, which adds cost to the manufacturing process, and can be prone to mechanical and electrical failure. In addition, the simple LED indicator used to signify the correct drawer containing the sought item provides no visual information about the identity of the item stored in the designated drawer.

SUMMARY OF THE INVENTION

The invention comprises an addressable drawer organizer which requires no separate signal conductors for coupling the externally supplied drawer identification signals to the drawer address comparison circuit, which eliminates the need for a positive detent mechanism to ensure effective electrical contact between the externally supplied drawer identification signals and the drawer address comparison circuit; and which further provides visible drawer item information to the user.

From an apparatus standpoint, the invention comprises a drawer organizer comprising a cabinet having a structure for providing a plurality of drawer locations; a plurality of drawers each slidably mounted in a different one of the drawer locations between a closed position and an opened position, each of the plurality of drawers having a front panel and a plurality of electronic drawer components including a display device mounted on the front panel for displaying information about items assigned to that drawer; a pair of ohmic conductors for providing electrical connection between the plurality of electronic components in the plurality of drawers and an associated controller; and a plurality of pairs of electrically conductive drawer slides each secured between a different one of the plurality of drawers and confronting portions of the cabinet to provide an electrically conductive slidable drawer mount for the corresponding one of the plurality of drawers, each one of the pair of electrically conductive drawer slides being electrically coupled to a different one of the pair of ohmic conductors and the plurality of electronic drawer components in the corresponding one of the plurality of drawers. The front panel of each of the drawers preferably includes an electrically activatable visible indicator, such as an LED. The display device preferably comprises a matrix display, such as an organic light emitting diode display. The plurality of drawers each has a pair of opposing side walls, and each of the plurality of pairs of electrically conductive drawer slides is preferably secured to the opposing side walls of the corresponding one of the plurality of drawers.

Preferably, the number of the plurality of drawer locations is equal to the number of the plurality of drawers.

The plurality of electronic drawer components includes a CPU for enabling communication with the associated controller, and a display device driver for providing display device driving signals.

From a process standpoint, the invention comprises a method for facilitating the drawer location of a sought item in a drawer organizer having individual drawers each including a drawer CPU, an item information display, a display driver, and an activatable visual indicator, such as an LED. The method proceeds by having a user enter the identification of a sought item, such as "aspirin 81 mg.", into a host computer using a conventional keyboard coupled to the host computer. The computer consults a stored master list of items registered in the system to find the drawer address identification information of the sought item and transmits this information to a controller. The controller then converts the drawer address identification information received from the host computer to a drawer address and conveys this address to all drawer CPU units. The drawer CPU containing the sought drawer address sends an address match signal to the controller, which transmits this result to the host computer. The host computer then consults the stored master list to retrieve the display information associated with the sought item and transmits this information to the controller, which relays this information to the drawer CPU having the matched address. The drawer CPU then supplies this display information to the display driver, which causes the display to display the item information. After the user retrieves the item from the correct drawer, the user operates the host computer keyboard to signify that the item has been removed from the drawer. The host computer then terminates the transmission of the display information.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
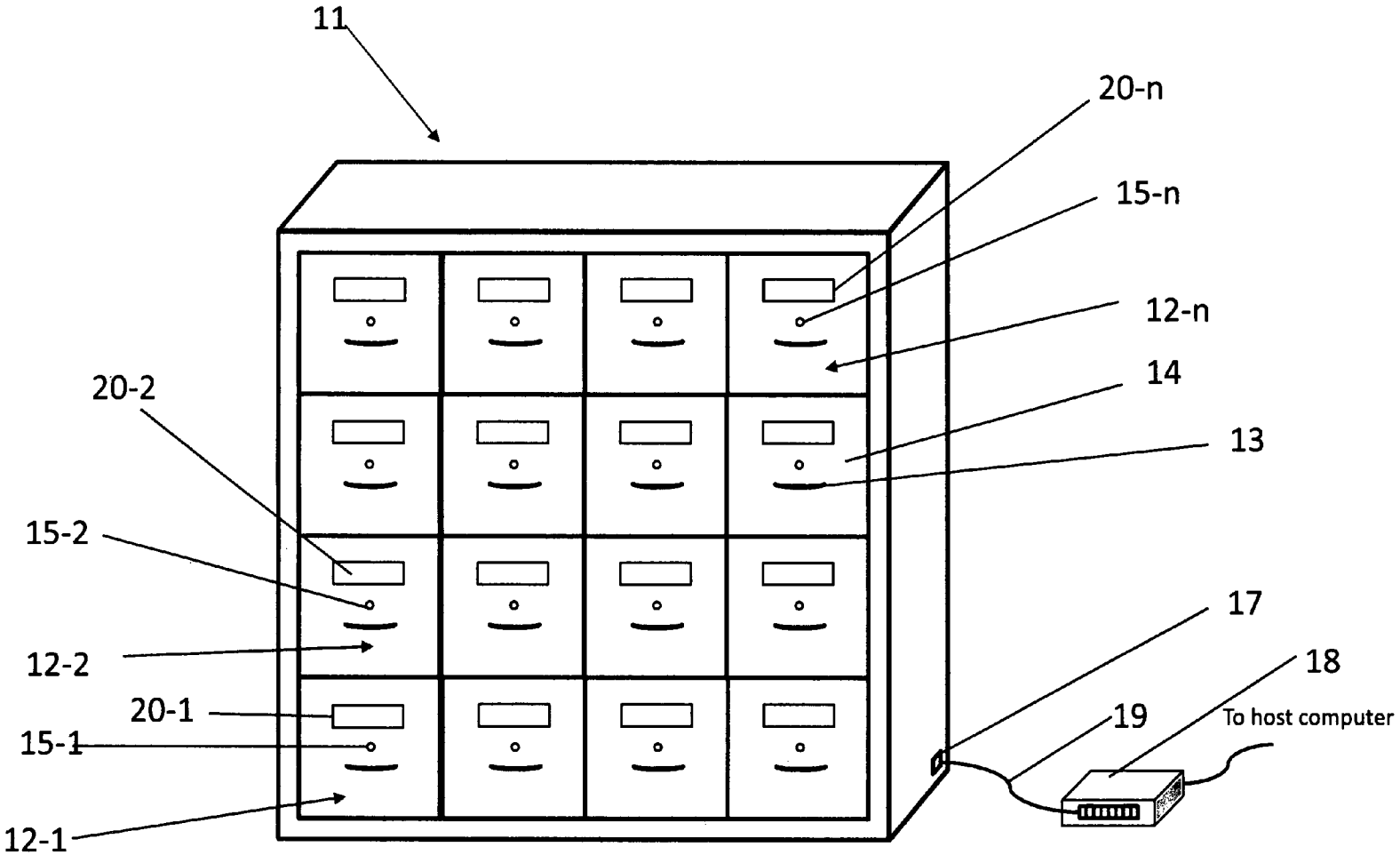
FIG. 1 is a perspective view of a drawer organizer incorporating the invention.
Figure 2:
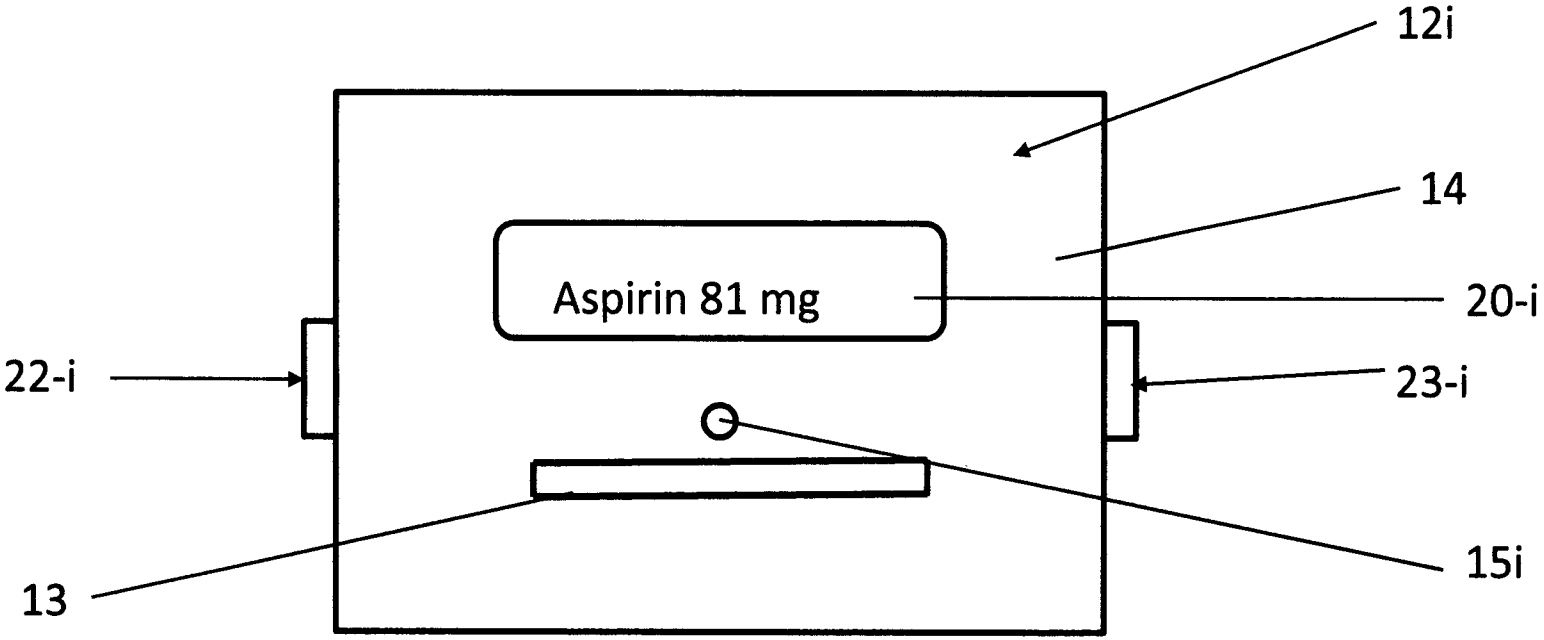
FIG. 2 is a front plan view of a single drawer of the embodiment of FIG. 1.

Turning now to the drawings, FIG. 1 is a perspective view of a drawer organizer incorporating the invention. As seen in this FIG., a cabinet generally designated with reference numeral 11 has a plurality of open locations for slidably housing a plurality of individual, essentially identical organizer drawers 12-1, 12-2, . . . , **12-*n* (with 16 drawers being illustrated in FIG. 1). Each drawer 12-1, 12-2, . . . , 12-*n* has substantially similar physical dimensions so that any of the drawers 12-1, 12-2, . . . , 12-*n* can be installed in any of the drawer locations in cabinet 11. Each drawer 12-1, 12-2, . . . , 12-*n* has a drawer pull 13 integrally formed with or attached to a front drawer panel 14 to facilitate opening and closing of the drawer. Each drawer 12-1, 12-2, . . . , 12-*n* has a visible indicator 15-1, 15-2, . . . , 15-*n* mounted on the front drawer panel 14. Visible indicators 15-1, 15-2, . . . , 15*n*** are preferably low cost light emitting diodes (LEDs), although other types of visible indicators, such as a flashing LED, incandescent lamps or liquid crystal displays (LCDs), may be used for this purpose.

Cabinet 11 includes a connector socket 17, preferably a USB connector, to which a controller 18 is electrically connected by means of a USB cable 19. Controller 18 is preferably a type AT89C2051 unit available from Intel Corporation of Santa Clara, Calif. and an address encoder such as a type PT2262 unit available from Princeton Technology Corporation of Taipei, Taiwan, and serves to receive drawer identification signals specifying a sought drawer from a host computer (not illustrated), furnish drawer address signals to circuits in each drawer (described below), and relay resulting signals from the drawer circuits to the host computer. Controller 18 may be configured to communicate with the host computer using wireless communication, such as wi-fi, or hard wired communication links.

With reference to FIGS. 1-4, each drawer **12-*i* is provided with a display panel 20-*i* for displaying information identifying the contents of a particular drawer. In the preferred embodiment, display panel is a type UG-2832 organic light emitting diode (OLED) 128×32 pixel display unit available from Univision Semiconductor, Inc of Taiwan. The display information is supplied to display panel 20*i* from the host computer via controller 18**.

Each drawer 12-I is slidably mounted in the corresponding cabinet drawer opening by conventional two-part drawer slides **22-*i*, 23-*i*. In the preferred embodiment drawer slides 22-*i*, 23-*i* are type CWH-10 electrically conductive drawer slides available from Cabinetmaker Warehouse of Jamestown, Tenn. The inner part of each drawer slide 22-*i*, 23-*i* is secured, respectively, to the left and right side walls of the drawer 12-*i* (see FIGS. 2 and 4). The outer part of each drawer slide 22-*i*, 23-*i* is secured to the adjacent wall portion of the opening in cabinet 11. Ball bearings located between the inner part and the outer part of each drawer slide 22-*i*, 23-*i* provide the relative sliding movement required between the drawer 12-*i* and the cabinet 11**.

Figure 3:
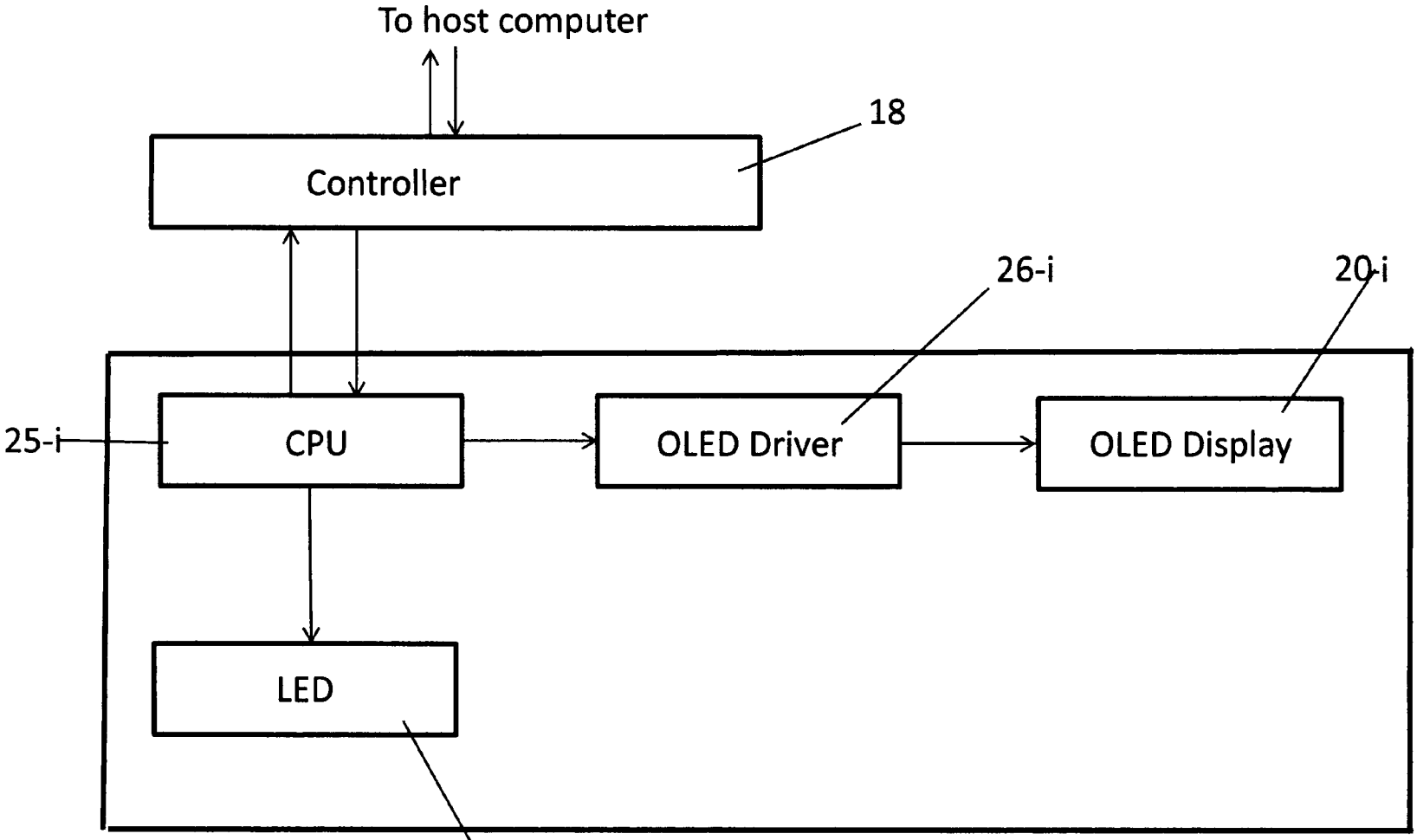
FIG. 3 is a block diagram illustrating the major electronic components of a single drawer.

FIG. 3 is a block diagram illustrating the major electronic components of a single drawer **12-*i*. As seen in this FIG., these major components include a CPU 25-*i*, an OLED driver 26-*i*, and the OLED display 20-*i*, which are all mounted on a circuit board 28-*i*, and the LED 15-*i* mounted on the front drawer panel 14. OLED driver 26-*i* is preferably a type SSD1305 driver unit available from Solomon Systech of Hong Kong and functions to convert display information instruction signals from CPU 25-*i* to display driver signals for display 20-*i*. CPU 25-*i* is preferably a type PIC16F1823 unit available from Microchip Technology, Inc. of Chandler, Ariz. and has several functions. First CPU 25-*i* receives drawer address signals from controller 18 and compares these signals with the drawer address stored in a memory portion of CPU 25-*i*. If there is a match between the drawer address signals and the stored drawer address, CPU 25-I sends a match signal to controller 18, which in turn informs the host computer that the correct drawer has been located. In response, the host computer sends display information to controller 18, which conveys this information to CPU 25-*i*. CPU 25-*i*, in turn, furnishes this display information to OLED driver 26-*i*, which applies the correct drive signals to OLED display 20-*i* thereby causing the information to be visibly displayed. In addition, CPU 25-*i* causes LED 15-*i*** to be activated so that the correct drawer can be visually located and opened.

Figure 4:
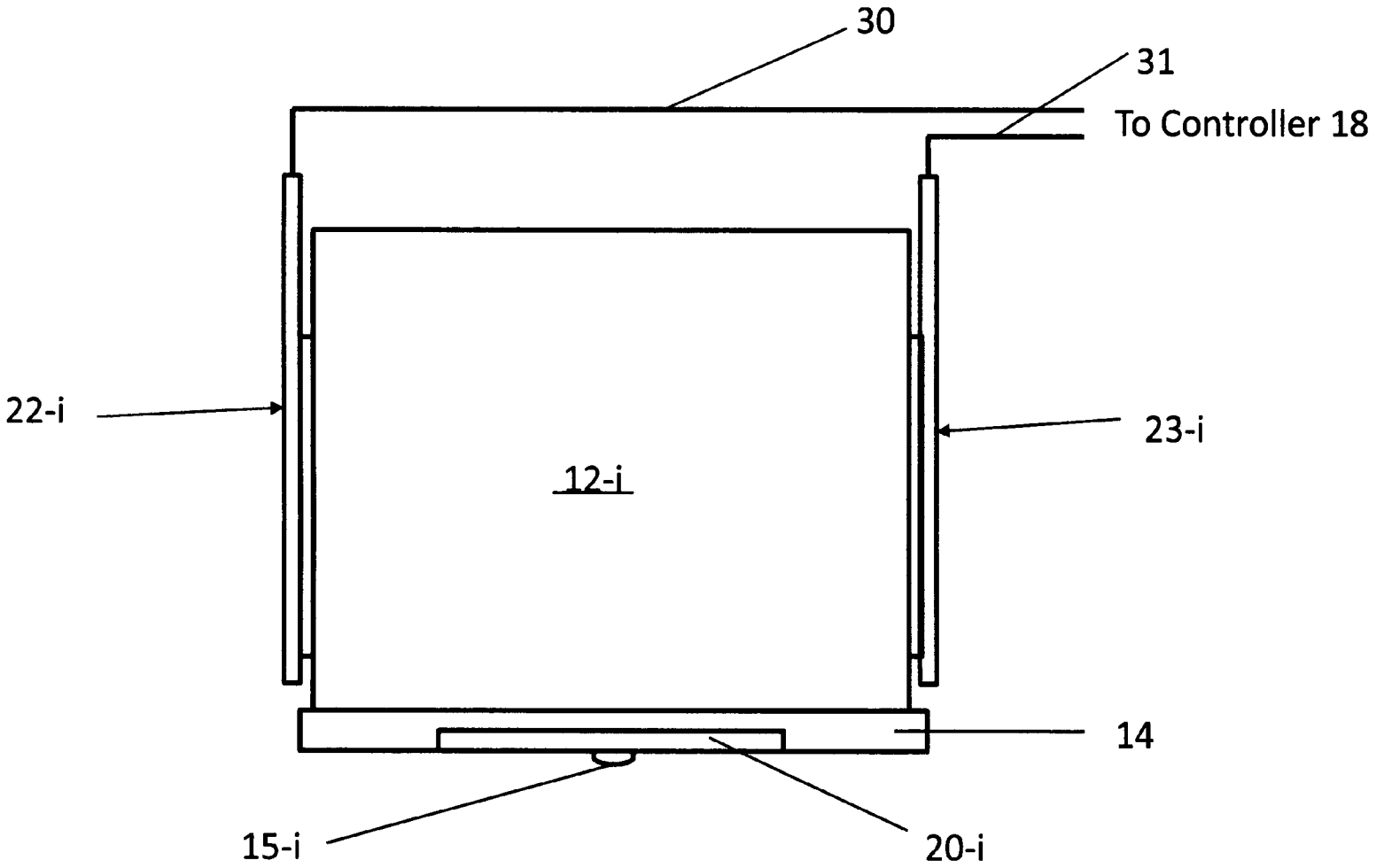
FIG. 4 is a top plan view of a single drawer.
Figure 5:
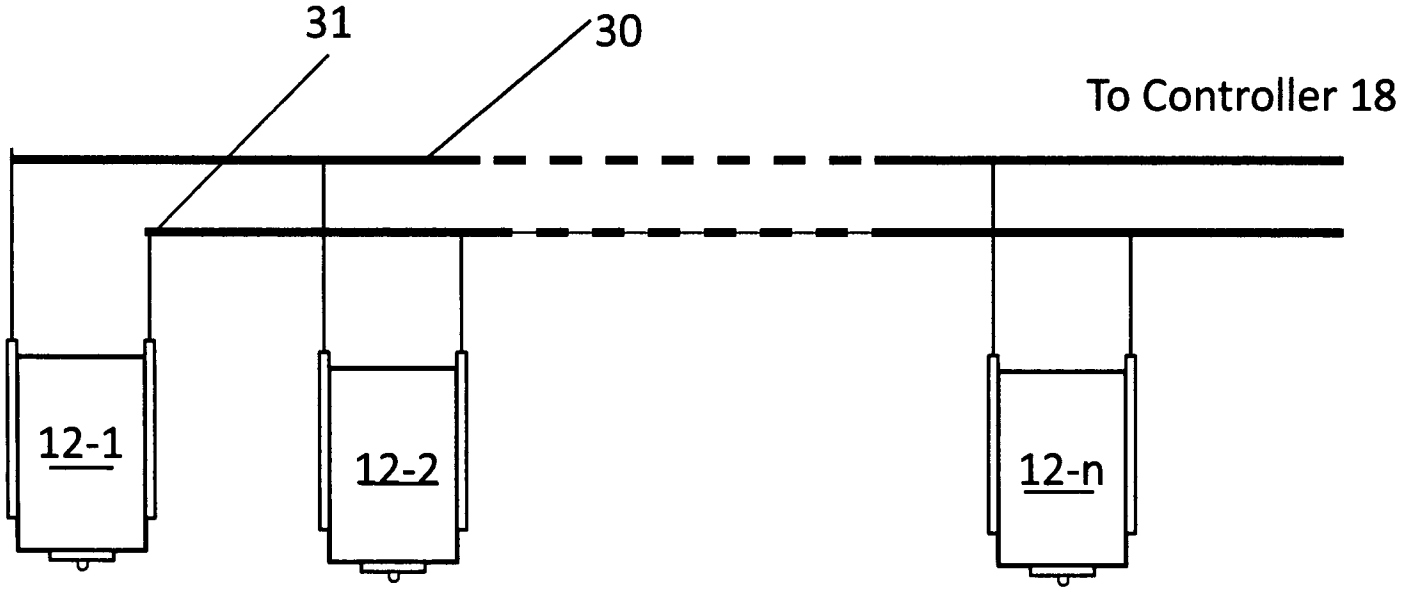
FIG. 5 is a schematic top plan view of a plurality of drawers illustrating the connection of several drawers to the drawer identification signal conductors.

A significant feature of the invention lies in the manner in which the drawer electronic components are electrically coupled to the controller 18. As best seen in FIGS. 4 and 5, the electronic components of each drawer **12-*i* are coupled to a pair of ohmic conductors 30, 31 via the drawer slides 22-*i*, 23-*i*. As best seen in FIG. 5, the drawer slides 22-*i*, 23-*i* of all drawers 12-*i* are all connected in parallel to the conductors 30, 31, which are connected to controller 18. This eliminates the need for separate and discrete ohmic conductors as employed in previously known drawer organizers, which simplifies the manufacturing process by eliminating the separate conductors, reduces the manufacturing cost by simplifying the assembly process, and reduces communication failures due to interruptions in connectivity due to manipulation of the drawers in and out of the cabinet 11. In addition, this ohmic arrangement ensures that power and data are still supplied to the drawer electronic components after the drawer is opened, which maintains the LED 15-*i* and display 20-*i*** active even when the drawer is in the open position. This provides visual feedback to the user who is in the process of retrieving one or more items from the designated, drawer.

In use, the user enters the identification of a sought item, such as "aspirin 81 mg.", into the host computer using a conventional keyboard coupled to the host computer. The computer consults a stored master list of items registered in the system to find the drawer address identification information of the sought item and transmits this information to controller 18. Controller 18 then converts the drawer address identification information received from the host computer to a drawer address and conveys this address to all drawer CPU units. The drawer CPU containing the sought drawer address sends the address match signal to the controller 18, which transmits this result to the host computer. The host computer then consults the stored master list to retrieve the display information associated with the sought item and transmits this information to the controller 18, which relays this information to the drawer CPU having the matched address. The drawer CPU then supplies this display information to the display driver, which causes the display to display the item information. After the user retrieves the item from the correct drawer, the user operates the host computer keyboard to signify that the item has been removed from the drawer. The host computer then terminates the transmission of the display information.

It has been observed during use of the system that occasionally power and/or data can be temporarily interrupted due to mechanical motion of the drawer slide components. When this happens, the display information might be lost. To overcome this potential loss of display information, the host computer is configured to repeatedly transmit the display information to controller 18 on a periodic basis, after the controller 18 has informed the host computer that the sought drawer has been located. In the preferred embodiment, a repetition interval of once every 0.5 seconds has been found to be effective.

As will now be apparent, drawer organizer systems incorporating the invention provide a number of significant advantages absent from the prior art. Firstly, as noted above, the elimination of the separate and discrete ohmic conductors simplifies the manufacturing process by eliminating the separate conductors, reduces the manufacturing cost by simplifying the assembly process, and reduces communication failures due to interruptions in connectivity due to manipulation of the drawers in and out of the cabinet 11. In addition, this ohmic arrangement ensures that power and data are still supplied to the drawer electronic components after the drawer is opened, which maintains the LED 15-*i* and display 20-*i* active even when the drawer is in the open position. This provides visual feedback to the user who is in the process of retrieving one or more items from the designated drawer. In addition, the provision of an item display panel enables the user to visually verify that the drawer designated by the activated LED 15 is the designated drawer for the sought item. Lastly, repeated transmission of the display information from the host computer to the cabinet controller ensures that temporary interruption of power and data to the drawer major electronic components will not invalidate the display information.

Although the above provides a full and complete disclosure of the preferred embodiments of the invention, various modifications, alternate constructions and equivalents will occur to those skilled in the art. For example, while the invention has been described with reference to a particular repetition period for the display information, other intervals may be chosen, as desired. Further, other major electronic drawer components than those specified for the preferred embodiment may be chosen, if desired. Also, although the drawer slides have been described and illustrated as being secured to opposing sides of each drawer, other configurations are possible, such as securing both slides to the bottom of the drawer. Therefore, the above should not be construed as limiting the invention, which is defined by the appended claims.

What is claimed is:

1. A drawer organizer comprising:

a cabinet having a structure for providing a plurality of drawer locations;

a plurality of drawers each slidably mounted in a different one of said drawer locations between a closed position and an opened position, at least some of said plurality of drawers each having specific items assigned thereto, a front panel and a plurality of electronic drawer components including a display device mounted on said front panel for displaying information about items assigned to that drawer, a CPU for receiving drawer address signals from an associated controller, for comparing the received drawer address signals with a drawer address stored in said CPU, for sending a match signal to said associated controller when the received drawer address signals and the drawer address stored in said CPU match, and for receiving display information from said associated controller identifying the drawer contents, said display information being repeatedly transmitted by said associated controller at periodic time intervals, and for generating corresponding display information instruction signals, and a driver unit coupled to said CPU and said display device for converting said display information instruction signals from said CPU to display driver signals for said display device so that said display device displays information identifying the drawer contents so long as said display information is transmitted from said associated controller to said CPU;

a pair of ohmic conductors for providing electrical connection between said plurality of electronic components in said at least some of said plurality of drawers and said associated controller; and a plurality of pairs of electrically conductive drawer slides each secured to a different one of said at least some of said plurality of drawers to provide an electrically conductive slidable drawer mount for the corresponding one of said at least some of said plurality of drawers, each one of said pair of electrically conductive drawer slides being electrically coupled to a different one of said pair of ohmic conductors and said plurality of electronic drawer components in the corresponding one of said at least some of said plurality of drawers.

2. The drawer organizer of claim 1 wherein all of said plurality of drawers have a front panel and a said plurality of electronic drawer components.

3. The drawer organizer of claim 1 wherein said front panel has an electrically activatable visible indicator coupled to said CPU.

4. The drawer organizer of claim 3 wherein said visible indicator comprises an LED.

5. The drawer organizer of claim 1 wherein said display device comprises a matrix display.

6. The drawer organizer of claim 5 wherein said matrix display comprises an organic light emitting diode display.

7. The drawer organizer of claim 1 wherein said at least some of said plurality of drawers each has a pair of opposing side walls; and wherein each of said plurality of pairs of electrically conductive drawer slides is secured to said opposing side walls of the corresponding one of said at least some of said plurality of drawers.

8. The drawer organizer of claim 1 wherein the number of said plurality of drawer locations is equal to the number of said plurality of drawers.

* * * * *